United States Patent [19]

Shank

[11] 4,098,053

[45] Jul. 4, 1978

[54] AUTOMATIC CONTAINER CAPPING APPARATUS

[75] Inventor: Harvey T. Shank, Papillion, Nebr.

[73] Assignee: Stauffer Chemical Company, Westport, Conn.

[21] Appl. No.: 801,596

[22] Filed: May 31, 1977

[51] Int. Cl.[2] ..... B65B 57/08; B65B 7/28

[52] U.S. Cl. ..... 53/72; 53/53; 53/77; 53/319; 53/352; 53/367

[58] Field of Search ..... 53/367, 72, 77, 67, 53/341, 352, 306, 307, 308, 319, 310

[56] References Cited

U.S. PATENT DOCUMENTS

| | | | |
|---|---|---|---|
| 2,506,363 | 5/1950 | Hohl et al. | 53/101 X |
| 2,839,883 | 6/1958 | Roberts et al. | 53/352 X |
| 2,983,089 | 5/1961 | Reese et al. | 53/72 |
| 3,293,823 | 12/1966 | Anderson | 53/307 X |

*Primary Examiner*—Travis S. McGehee
*Attorney, Agent, or Firm*—Leydig, Voit, Osann, Mayer & Holt, Ltd.

[57] ABSTRACT

The disclosure provides an automatic capping apparatus for placing a cap on the opening of a container and crimping the cap onto the opening to seal the container. The capping apparatus includes three operating stations through which the containers are moved on a conveyor — an aligning station to position the container on the conveyor, a cap pickup and placing station to deposit a cap on the opening of the container, and a crimping station for crimping the cap onto the opening. Furthermore, sensing means are provided at the pickup and placement station and the crimping station to assure that the operation at those stations is successfully accomplished.

8 Claims, 7 Drawing Figures

62
64
50
66
14
70
48
56
52
36
34
12
13
68
72
76
78
82
84
47
11
74
80
18
44
46
22
22

92
70
94
72
92
88
90

7
104
100
114
116
107
108
110
109
115
111
120
122
105
112
106
118
104
100
120
114
108
107

AUTOMATIC CONTAINER CAPPING APPARATUS

BACKGROUND OF THE INVENTION

This invention relates generally to the art of automated packaging of materials and particularly to a machine for capping containers.

Chemical products in liquid form, such as herbicides, insecticides, oil, grease, and other chemicals, are often packaged and sold in five-gallon drum containers. The five-gallon drum containers or cans are generally cylindrical in shape with a flat top and bottom. A folddown handle is generally provided in the middle of the top of the can and a circular opening for filling and emptying the can is also provided in the top adjacent the edge of the can. The can is sealed for shipment and storage by capping the opening in the top of the can.

Conventionally, the circular opening in the can has an outwardly protruding ridge around its circumference. A cap having deformable metal edges is placed over the opening, and the edges of the cap are crimped onto the protruding ridge to attach the cap securely to the can and thereby to seal the can.

In order to open the can to empty the contents, the cap has a removable center portion. The center portion can be threaded or adapted to be pried open. The center portion of the cap may also have a retractable spout to facilitate pouring of liquid material from the can.

In the past, capping the can by crimping the cap over the ridge of the opening was accomplished by hand using a hand held crimping tool or crimper. The person, whose job was to cap the can, had to assure that there was a cap placed over the opening, that the cap was properly seated upon the ridge around the opening and that the crimper was properly seated upon the cap so that when the cap was crimped, a secure seal was made.

The capping procedure defied attempts at automation for several reasons. First, the cans varied in height by as much as a quarter of an inch from the nominal height. Furthermore, the tops of the cans were often tilted or were concave or convex as opposed to being perfectly flat and level. Moreover, the opening was not consistently spaced from the edge of the can or located with regard to the can's handle. These variations made it difficult to accurately locate the opening and thus assure proper placement of the cap over the opening and proper seating of the crimper on the cap.

Also, the caps varied in their consistency of quality. It was not uncommon to receive caps from manufacturers which were twisted or bent so that they did not properly seat on the ridge prior to crimping. It was therefore necessary for a human to assure that all parts of the cap and ridge were properly seated and that the crimping tool was properly seated on the cap in order to assure a reliable seal of the cap on the can.

If an automated capping machine fails to assure proper seating of cap and crimping tool and the crimping operation occurs, an improper seal may be made. Such a seal may leak during storage and shipment thereby creating a potential hazard if the chemical is toxic or flammable.

Also improper seating of the cap and crimper prior to crimping may damage the opening's ridge so that the container cannot by properly sealed subsequently.

Therefore, it is an object of the present invention to provide an automatic capping apparatus which reliably caps cans by allowing for the variations in the height of the cans and the orientation of the opening in the can top.

It is also an object of the present invention to provide an automatic capping apparatus having an aligning mandrel for accurately locating the opening in the can to assure that the caps are reliably placed over the opening and seated on the ridge so that the crimping tool will properly seat on the caps prior to crimping.

It is further an object of the present invention to provide an automatic capping apparatus having a cap placer which can determine whether or not a cap has been placed over the opening of the can.

It is also an object of the present invention to provide an automatic capping apparatus having a flexibly supported crimper with a sensing means attached to it to determine whether or not the crimper has properly seated on the cap prior to crimping the cap.

Other objects and advantages of the invention will become apparent upon reading the following detailed description and upon reference to the drawings, in which:

FIG. 2 is a top view of the automatic capping apparatus;

While the invention will be described in connection with a preferred embodiment, it will be understood that I, do not intend to limit the invention to that embodiment. On the contrary, I intend to cover all alternatives, modifications and equivalents as may be included within the spirit and scope of the invention as defined by the appended claims.

Figure 1:
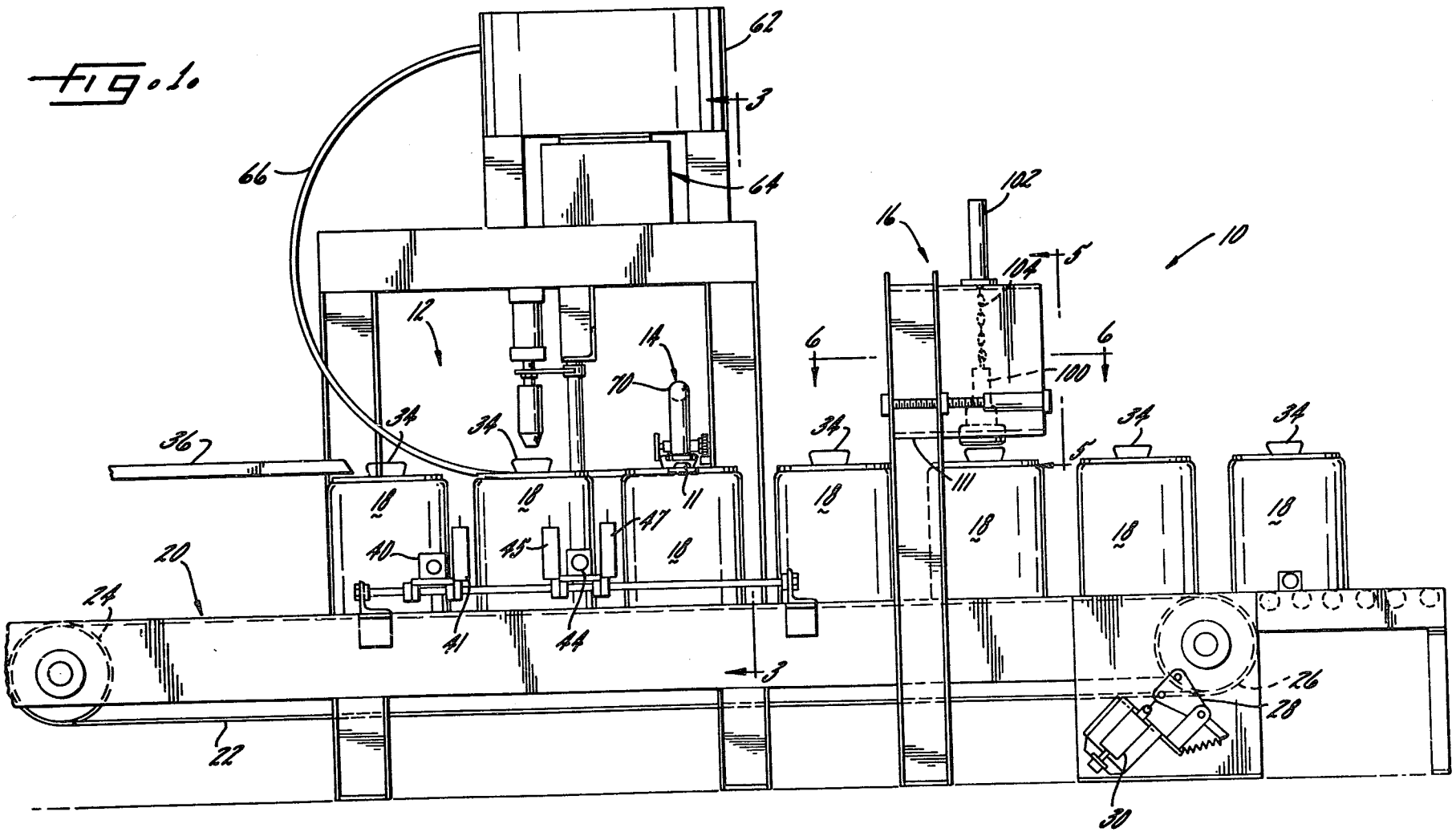
FIG. 1 is an elevation view of the automatic capping apparatus embodying the present invention.

Turning to the drawings, FIGS. 1 and 2 show an automatic capping apparatus generally at 10 which automatically seals a can 18 having an opening 13 with an outwardly protruding ridge by crimping a cap 11 having a deformable edge 15 (FIG. 7) onto the ridge of the opening. The automatic capping apparatus incorporates three operating stations —a can aligning station 12 which aligns each can 18 on a conveyor 20, a cap pick-up and placement station 14 which picks up cap 11 and places it on the can's opening 13, and a crimping station 16 which crimps cap 11 onto the ridge of the opening 13.

Cans to be capped are moved from operating station to operating station by means of the conveyor 20 which consists of a conveyor belt 22 disposed between idle roller 24 and drive roller 26. The drive roller 26 is driven by a ratchet and pawl mechanism 28, which is activated by a pneumatic cylinder 30. The combination of the pneumatic cylinder 30 and the ratchet and pawl mechancism 28 allows the conveyor belt 22 to be indexed in discrete, precise increments each time the pneumatic cylinder is activated. In this way, the movement of the conveyor belt 22 can be accurately controlled, and therefore, once the cans are properly positioned on the conveyor belt at the aligning station 12, the cans, and more particularly the openings of the cans, will be properly aligned at subsequent operating stations 14 and 16.

Positioning the cans on the conveyor belt is accomplished in three ways. First the rotational positioning of the cylindrical shaped can 18 on the conveyor belt is roughly accomplished by means of a fixed guide 36 which engages handle 34 of each can 18. Because the handle 34 of the can is attached to the can in a generally fixed relationship with respect to the opening 13, positioning the handle with respect to the fixed guide 36 roughly assures that the opening 13 is rotated toward the back side of the conveyor as shown in FIG. 2.

Second, in order to determine the position of the can, and therefore the opening 13, with respect to the incremental indexing of the conveyor belt 22, two pairs of can stops, pneumatic cylinders 40, 42, 44 and 46, are provided. The first pair of can stop cylinders 40 and 42 provide a means of separating the cans one from the other as they move along the conveyor in order to relieve any pressure on the first can from the trailing cans. The second pair of can stops, cylinders 44 and 46, establish the can's position with respect to and in synchronization with the incremental movement of the conveyor belt 22 in order to assure that for every subsequent indexing of the conveyor belt 22, the can is predictably positioned. The can stops are activated in a predetermined sequence by limit switches 41, 45 and 47 which are tripped by the passage of the cans on the conveyor belt.

Figure 3:
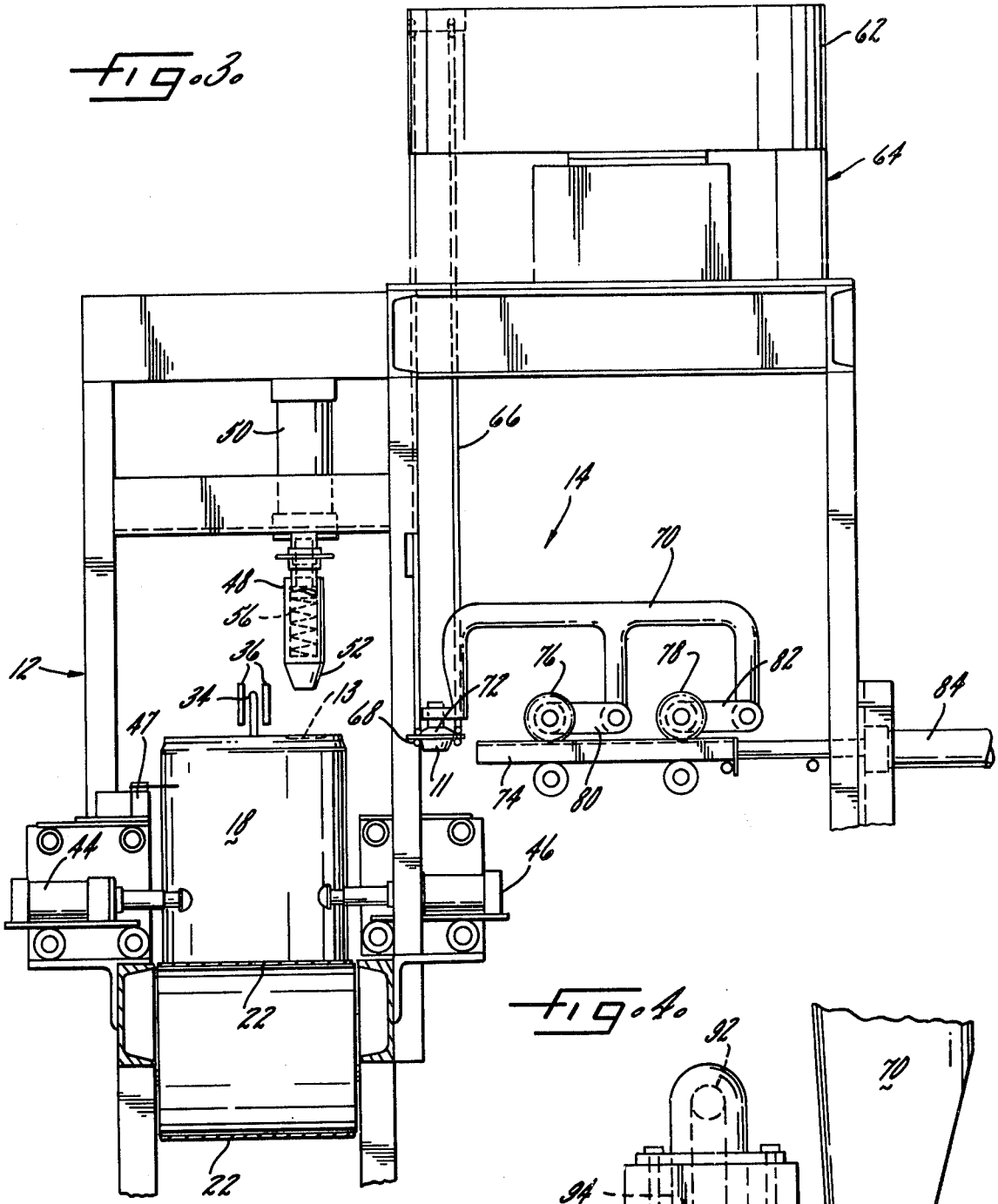
FIG. 3 is a sectional view of the automatic capping apparatus along line 3—3 of FIG. 2 and shows the aligning mandrel and the cap placer of the automatic capping apparatus.

Finally, a fine positioning of the can is accomplished at the aligning station 12 by means of a mandrel 48, carried by a fixed overhead cylinder 50, which mandrel descends into the opening 13 to assure precise positioning of the opening with respect to the conveyor belt 22. As best seen in FIG. 3, the mandrel 48 has a diameter which is only slightly less than that of the opening 13. The mandrel also has a tapered end 52 which allows the mandrel to initially engage a misaligned opening 13 and then provide a camming surface to force the opening into alignment. The mandrel 48 also is mounted to the piston of the cylinder 50 by means of spring 56. The spring mounting is provided to assure that if the opening is not within the area under mandrel (for example a can turned 180°), the mandrel will give and not damage the top of the can.

Once each can's opening is properly aligned with respect to the conveyor belt as described above, it is necessary to accurately place a cap 11 (FIG. 3) onto the opening 13. Placing a cap 11 onto the opening 13 is accomplished at the cap pick-up and placement station 14. Loose caps are placed in a hopper 62 of a cap separator mechanism 64 of the conventional design. The separator 64 directs the caps into a gravity fed semi-circular shaped slide 66 which delivers the caps sequentially to a pick-up position 68 at the bottom end of the slide 66. A pick-up arm 70 with a cap gripping mechanism 72 attached to one end oscillates in an arc between the pick-up station 68 and the opening 13 of the can 18 to sequentially pick-up a cap at the pick-up station, deposit it on the opening 13; and return to its initial position.

The oscillation of the pick-up arm 70 is controlled by means of rack 74 and pinion gears 76 and 78 which gears are operatively attached to the pick-up arm 70 by means of cranks 80 and 82, fixed to gears 76 and 78 respectively. The rack 74 is controlled by pneumatic cylinder 84 which retracts in order to rotate gears 76 and 78 counterclockwise and in turn to oscillate the pick-up arm 70 from a first pick-up position in which the gripping mechanism 72 is adjacent the pick-up station 68 to a second cap depositing position where the gripping mechanism 72 is adjacent the opening 13 of the can 18.

Figure 4:
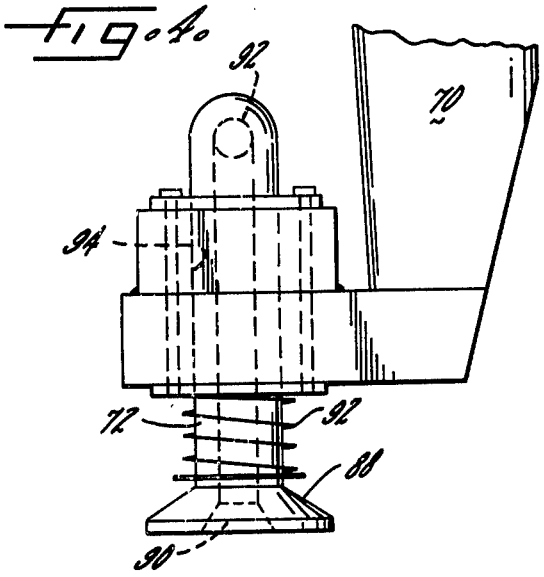
FIG. 4 is an enlarged fragmentary view of one end of the cap placer which end includes a gripping means for picking up a cap.

As shown in enlarged FIG. 4, the cap gripping mechanism 72 consists of a bell shaped portion 88 with an internal end cavity 90 which is attached to a reversible source of pneumatic pressure (not shown) by means of a duct 92. When the bell-shaped portion 88 comes in contact with the flat top of cap 11 and vacuum pressure is applied to duct 92, the resulting vacuum created in the internal end cavity 90 holds the cap against the bell-shaped portion 88 of the gripping mechanism 72.

In order to accommodate cans of varying height, the cap gripping mechanism 72 is resiliently mounted on the pick-up arm 70 by means of spring 92 so that the pick-up mechanism 72 can retract into sleeve 94 mounted on the pick-up arm when the can opening is encountered before the pick-up arm has completed its oscillation from the pick-up position toward the can opening.

Once the pick-up arm has oscillated to its cap depositing position at the opening of the can, the cap 11 is released from the pick-up mechanism 72 by reversing the air flow in duct 92 so as to create positive pressure in cavity 90 instead of vacuum.

Also, in order to determine whether a cap has been properly been picked up, and in accordance with the present invention, an air switch of conventional design (not shown) is mounted within duct 92 to determine when air is flowing in the duct 92. If a cap is present at pick-up station 68, the cap will cover the bell-shaped portion 88, thereby blocking the internal cavity 90. With internal cavity 90 blocked, no air can flow in duct 92, and the air switch will not be activated.

On the other hand, if no cap is present at pick-up station 68 or if the cap is bent and does not provide a flat surface to block the bell-shaped portion 88, then air will freely flow into the cavity 90 and in duct 92, thereby activating the air switch. The activated air switch informs the machine control that a cap was not picked up at the pick-up station. In the preferred embodiment, after two consecutive pick up failures, the line stops and an alarm is sounded.

After the cap has been properly picked up and placed on the opening 13 at the station 14, the conveyor is indexed again, and the can is moved to the crimping station 16. At the crimping station 16, a crimper 100, suspended from a pneumatic cylinder 102 by means of a chain 104, is lowered onto the cap and operates to crimp the edge 15 of the cap 11 (FIG. 7) onto the outwardly protruding ridge of the opening 13 of the can.

Figure 5:
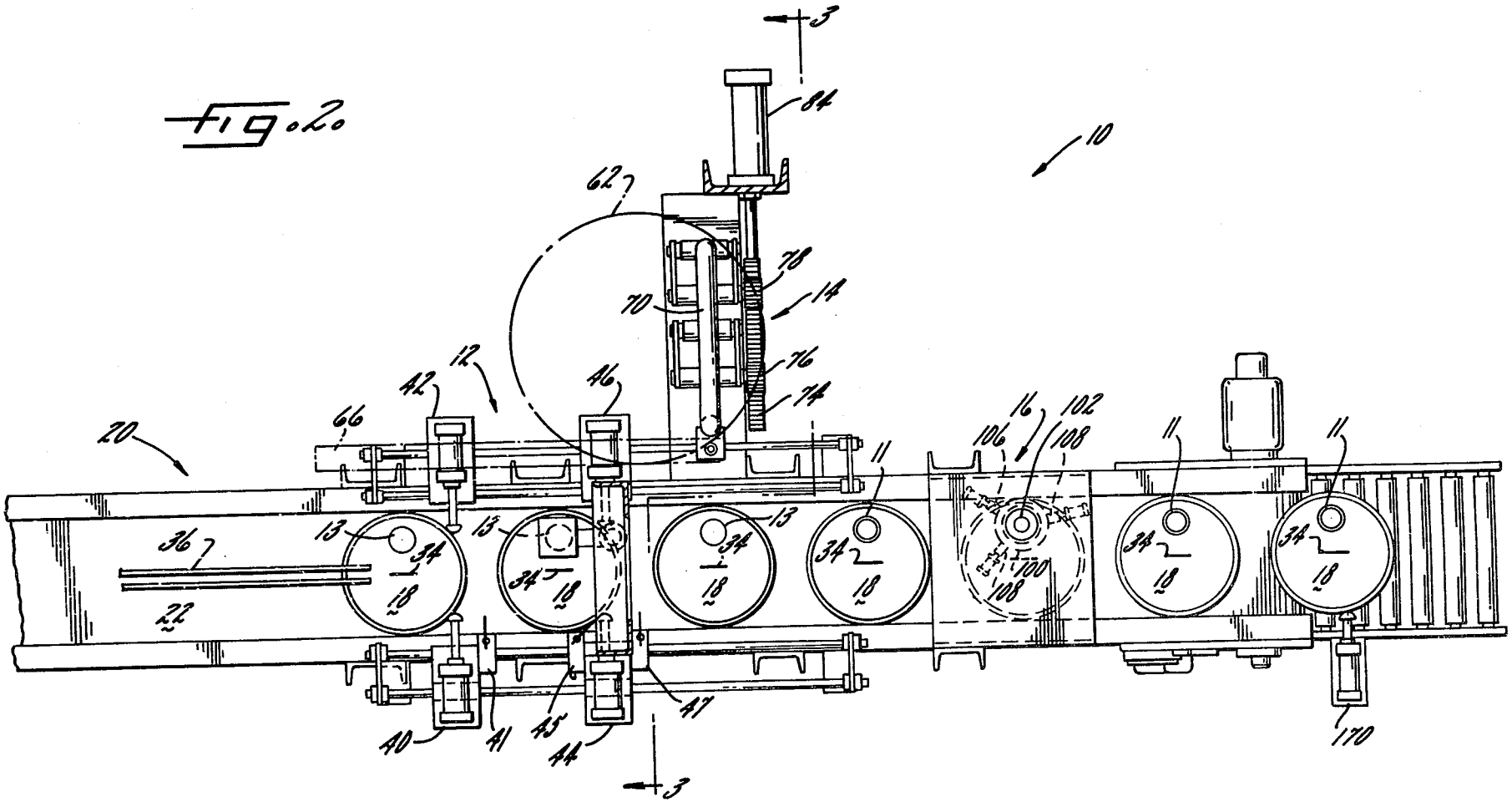
FIG. 5 is sectional view of the automatic capping apparatus along line 5—5 of FIG. 1 and shows the crimper.
Figures 5, 6:
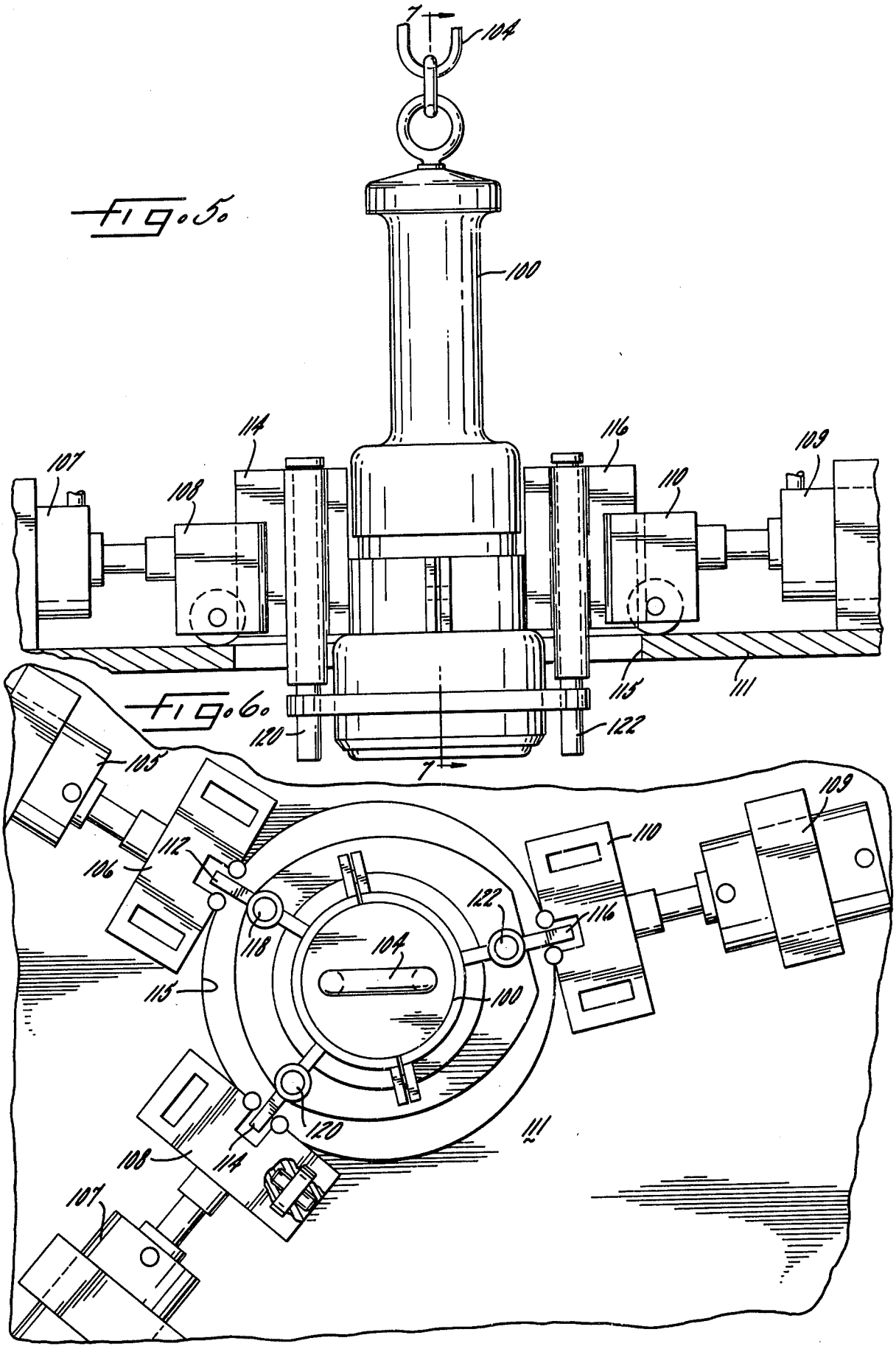
FIG. 6 is a sectional view of the automatic capping apparatus along line 6—6 of FIG. 1 and shows the crimper.

In order to assure that the crimper 100 properly seats onto the cap which has been placed on the opening of the can, the crimper 100 is aligned in the horizontal plane by means of three retractable guides 106, 108 and 110 which are operatively attached to pneumatic cylinders 105, 107 and 109, respectively (FIGS. 5 and 6). The three cylinders are fixedly mounted on the horizontal base 111 of the crimping station and are spaced around the periphery of the crimper 100. The three retractable guides slideably engage vanes 112, 114 and 116, respectively, which vanes are fixedly attached to the crimper.

While the crimper is being lowered through base opening 115 in base 111 toward the top of can 18, the three guides retract to allow the crimper to move in any horizontal direction in order to settle onto the cap. Also, because the crimper is flexibly suspended by chain 104, and because the stroke of cylinder 102 exceeds the greatest distance through which the crimper can travel in the vertical direction to reach the top of the can, the crimper is also able to tilt so as to accomodate a tall can or one which has an irregular or tilted top.

Finally, in order to assure that the crimper has properly seated on the cap, the crimper is provided with a can top sensing means. The sensing means consists of three hollow tubes 118, 120 and 122 attached to the fixed vanes 112, 114 and 116, respectively. The hollow tubes are each connected at their top ends to a source of pneumatic pressure (not shown). Each tube has an air switch in series with it and the source of pressure. The air switches are of conventional design and determine when air is flowing in each of the three tubes 118, 120 and 122. If the crimper has properly settled onto a cap on a can, the lower ends of the hollow tubes 118, 120 and 122 abutt against the top of the can, and the air flowing in each of the tubes is blocked. The air switches sense the resulting decrease in air flow and signal the machine control that the crimper has in fact seated onto the cap in the proper manner.

If on the other hand, the cap is misplaced on the opening thereby preventing seating of the crimper, one or more of the tubes will fail to abutt the can's top. The continuing flow of air in that tube will be sensed by the air switch, the air switch will signal the machine control mechanism, and the crimping operation will be inhibited. Moreover, the failure of the crimping operation is recorded so that subsequently, reject cylinder 170 can remove the unsealed can from the line for rework.

Figure 7:
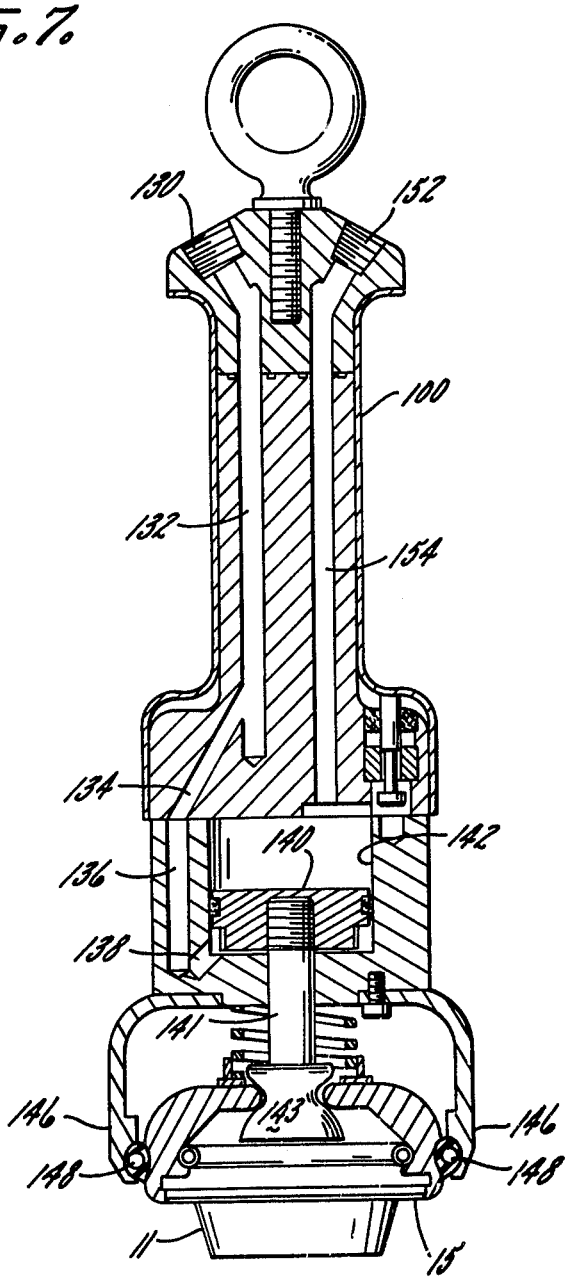
FIG. 7 is a sectional view of the crimper along line 7—7 of FIG. 6

Once the crimper 100 has been properly seated on a cap 11 on the opening of a can, the crimper operates in the following manner with reference to FIG. 7. Hydraulic fluid is forced into opening 130 of the crimper. The hydraulic fluid communicates through passages 132, 134, 136 and 138 to force piston 140 to rise in cylinder 142. Piston 140 is connected via rod 141 and flange 143 to crimping jaws 144. As the piston of 140 is driven upwardly, the crimping jaws 144 disposed around the circumference of crimper base 146 pivot at pivot points 148 and crimp the edges 15 of the cap 11 thereby making the seal. At the end of the crimping operation, the hydraulic pressure at opening 130 is released, and pneumatic pressure is introduced at opening 152 which communicates by means of passage 154 to cylinder 142 thereby forcing the piston 140 down and releasing the cap 11 from the crimping jaws 144.

After the cap has been crimped, the pneumatic cylinder 102 retracts lifting the crimper 100 off of the can, and the retractable guides extend to engage the crimper vanes and align it in the proper horizontal position prior to its next operation.

After the crimping operation has been completed at station 16, the conveyor is indexed, and the can moves until it reaches the reject cylinder 170 (FIG. 2). If either of the machine operations at stations 14 or 16 was not been carried out successfully, for example, the air switch on the gripping mechanisms sensed that no cap had been picked up or the air switches connected to the three hollow tubes on the crimper determined that the three tubes were not all blocked, then the machine control at the proper time activates reject cylinder 170 which pushes the can off of the line so that it may be returned for rework.

Having thus described the operation of each of the stations of the capping apparatus, the operating sequence of the apparatus will next be described. A group of closely spaced cans 18 approach the capping apparatus 10 on the conveyor belt 22 from a filling station (not shown). The handle of each can is engaged by guide 36 in order to assure that the opening is roughly located on the back side of the conveyor belt as seen in FIG. 2.

The first can of the group passes through the first stop cylinders 40 and 42 which are initially in the retracted position. After the first can has cleared limit switch 41, the first stop cylinders 40 and 42 are extended in order to stop the second can and thereby relieve any pressure against the first can from the trailing cans. The first can proceeds toward the initially extended stop cylinders 44 and 46 until it engages those stops and is halted. Limit switch 45 detects the presence of a can at stop cylinders 44 and 46 and causes the conveyor to stop after it has indexed a short distance to insure that the first can is securely positioned against stop cylinders 44 and 46.

After the conveyor stops there is a momentary delay before stop cylinders 44 and 46 retract so that when the mandrel subsequently descends, the can will be free to be moved in response to the operation of the mandrel. After the mandrel has completed its stroke and has returned to its up position as determined in the conventional manner by limit switches attached to the cylinder 50, the conveyor begins indexing to move the first can toward the cap pick-up and placement station 14.

As the first can leaves aligning station 12, it trips limit switch 47 which causes stop cylinders 44 and 46 to extend in anticipation of the second can moving from its position at stop cylinders 40 and 42 toward stop cylinders 44 and 46.

When the first can reaches the cap pick-up and placement station 14, a limit switch (not shown) senses its presence to stop the conveyor. Once the conveyor has stopped at the proper incremental position, the opening of the can is properly aligned at station 14, and the pick-up arm 70 oscillates in an arc-shaped path between its pick-up position 68 and the opening 13 and places a cap on the opening. During a cap placement the pneumatic pressure source first creates a vacuum at the cap gripping mechanism to pick up a cap and then reverses the air flow to release the cap at the can's opening. If there was no cap at the pick-up station 68 to block the air flow in the cap gripping mechanism 72, the air switch in duct 92 signals the machine logic that the cap was not properly placed on the first can. When that can finally reaches reject cylinder 170 at a predetermine later time, piston 170 is activated to remove the can from the assembly line for rework. If at the cap pick-up and placement station 14 two successive operations are unsuccessful, then an alarm is sounded, and the entire operation is halted until the supply of caps can be checked.

While the pick-up arm was oscillating in order to place a cap on the first can's opening, the mandrel 48 at the aligning station 12 was also operating to align the second can so that the second can is ready to proceed to the cap pick-up and placement station.

After the operation at the cap pick-up and placement station 14 is completed, conveyor belt 22 begins indexing to move the first can toward the crimping station 16. When the first can reaches crimping station 16, a limit switch senses its presence and stops the conveyor belt at the proper incremental position to assure alignment. Once the conveyor belt has stopped, the piston 102 extends and lowers the crimper onto the cap. While the piston of cylinder 102 is extending, the retractable aligning guides 106, 108, and 110 are retracted so as to allow the crimper to adjust in the horizontal plane and thereby settle onto the cap.

If the crimper settles onto the cap properly, all three of the air tubes 118, 120, and 122 will be blocked by the top of the can indicating to the machine control that the crimping operation should be initiated.

If for some reason the crimper does not settle onto the cap and any one of the three hollow tubes is not blocked, then the machine control inhibits the crimping operation and activates the cylinder 102 to raise the crimper off of the can. The machine control also records the fact that the crimping operation did not take place. When the can reaches the reject cylinder 170, it is removed from the line. If two successive crimp operations are inhibited, the line is shut down and an alarm is sounded.

I claim:

1. Apparatus for capping a container, which container has an opening with an outwardly protruding ridge surrounding the opening and a cap with deformable edges adapted for seating on the ridge and being crimped onto the ridge, the apparatus comprising:

a. conveyor means for supporting and moving the container in predetermined increments through operating stations of the apparatus;

b. a first station comprising aligning means for aligning the container in a predetermined relationship on the conveyor means, the aligning means including a mandrel having a tapered opening engaging end, the mandrel being located in a predetermined relationship to the conveyor means and operable mounted to extend and engage the opening of the container with its tapered end and thereby align the opening of the container in a predetermined relationship to the conveyor means;

c. a second station comprising a cap placer for placing the caps on the opening of the container, the cap placer including delivery means for supplying caps one at a time to a pick-up position and a pick-up arm with a cap gripping means attached to it wherein the pick-up arm with its attached cap gripping means oscillates between the cap pick-up position and the opening of the container so that the cap gripping means first grips the cap at the pick-up position and then places the cap on the opening of the container and releases it; and d. a third station comprising a crimper having crimping jaws for crimping the cap onto the ridge around the opening of the container and means for movably and flexibly supporting the crimper adjacent the cap on the ridge of the opening so that the crimper can move toward the cap for engagement of the jaws therewith.

2. The apparatus of claim 1, wherein the aligning means further includes first stop means for separating the container to be capped from every other container on the conveyor means and second stop means for aligning the container with respect to the predetermined increments of conveyor means.

3. The apparatus of claim 2, wherein the mandrel is operably mounted by means of a spring so that the spring can provide relief in the event that the mandrel's tapered end encounters an obstacle instead of the container's opening.

4. The apparatus of claim 1, wherein the third station includes retractable guide means for first engaging and aligning the crimper as it moves toward the cap and then retracting to allow the crimper freely to seat on the cap.

5. The apparatus of claim 1, wherein the third station includes sensing means having a plurality of air tubes and a plurality of associated air switches each tube and associated switch respectively connected in series to a source of pneumatic pressure and operable so that when the crimper is seated on the cap each tube is blocked thereby activating the air switches.

6. A cap sealing device for crimping a cap having a deformable edge onto a protruding ridge surrounding an opening of a container, the cap sealing device comprising:

a. a crimper having a plurality of jaws adapted for engaging the cap's deformable edge and crimping it;

b. means for movably and flexibly supporting the crimper adjacent the cap seated on the protruding ridge of the opening so that the crimper can be moved toward the cap for engagement of the jaws therewith;

c. retractable guide means for first engaging and aligning the crimper as it moves toward the cap and then retracting to allow the crimper freely to seat on the cap; and d. sensing means carried by the crimper to determine when the crimper has fully seated on the cap.

7. The cap sealing device of claim 6, wherein the sensing means includes a plurality of air tubes and a plurality of associated air switches each tube and associated switch respectively connected in series to a source of pressure and operable so that when the crimper is seated on the cap each tube is blocked thereby activating the air switches.

8. A cap placing device for placing a cap on an opening of a container comprising:

a. delivery means for supplying the caps to a pick-up position;

b. a pick-up arm with cap gripping means attached thereto, the pick-up arm being operatively connected to crank means and gear means which crank means and gear means are together rotatable so that the cap gripping means oscillates in an arc between the pick-up position and the opening of the container; and c. sensing means associated with the cap gripping means to determine if a cap has been picked up by the cap gripping means.

* * * * *